United States Patent [19]

Ramsay

[11] Patent Number: 5,024,428

[45] Date of Patent: Jun. 18, 1991

[54] MAGNETIC WORKPIECE CLAMPING BLOCKS

[75] Inventor: Ronald Ramsay, Plymouth, N.H.

[73] Assignee: Academy of Applied Science, Concord, N.H. ; a part interest

[21] Appl. No.: 548,135

[22] Filed: Jul. 5, 1990

[51] Int. Cl.[5] ..... B25B 1/24

[52] U.S. Cl. ..... 269/274; 269/276; 269/275

[58] Field of Search ..... 269/276, 8, 286, 277, 269/273, 274

[56] References Cited

U.S. PATENT DOCUMENTS 2,606,470 8/1952 Kinney ..... 269/276
2,796,787 6/1957 Aske ..... 269/279
4,484,745 11/1984 Sleeper ..... 269/8

FOREIGN PATENT DOCUMENTS 141893 5/1985 European Pat. Off. ..... 269/276
1313223 9/1973 United Kingdom ..... 269/276

*Primary Examiner*—Robert C. Watson
*Attorney, Agent, or Firm*—Rines & Rines

[57] ABSTRACT

A novel magnetic workpiece clamping block carrying resilient magnetized plastic surfacing over its complete clamp-engaging surface and of dimensions larger than the clamp to enable ready adjustment of different block areas held to the clamp, all without separation therebetween; and increased magnetic holding to the clamp during clamping with and cushioning of the workpiece on the other surface of the block during clamping.

6 Claims, 3 Drawing Sheets

UNCLAMPED

CLAMPED

MAGNETIC WORKPIECE CLAMPING BLOCKS

Figure 1:
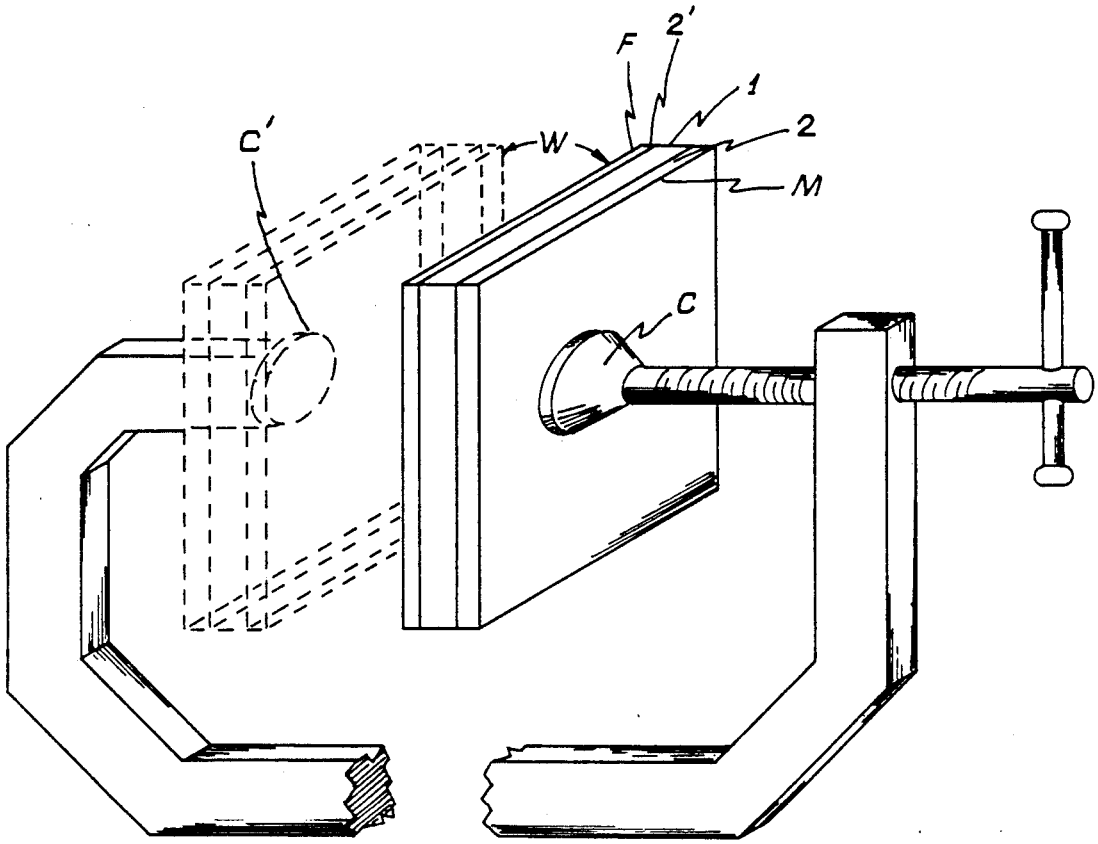

The present invention relates to clamping blocks for insertion between the workpiece and the ferrous metal jaws or clamping surfaces of wood-working and other clamps, vises and the like, being more particularly concerned with readily attachable blocks provided with magnetic surfaces for holding the blocks against the metal clamping surfaces, while also permitting separation therefrom as desired.

BACKGROUND

The art is replete with suggestions for attaching blocks or liners by magnets to the ferrous metal jaw or clamping surfaces of clamps and vises and the like to provide a more pliable clamping surface against the workpiece than the hard clamping surfaces and thereby prevent surface damage to the workpiece. Exemplary of such proposals are the structures described in U.S. Pat. Nos. 2,606,470; 2,666,352; 3,065,960; 3,502,318; 3,811,668; and 4,569,511, and in German Patent No. 2,154,287, EPO Patent 0141893 and in the article appearing in American Machinist, "Magnets Hold Wooden Vise-Jaw Liners," July 14, 1958, p. 118. Some of these proposals require modification of the jaw or clamping surfaces to receive magnetic holding elements; others, fittings over the clamping surface edges; and still others require special attaching techniques to the blocks. All appear limited, however, to a fixed and predetermined single position of magnetic attachment of the block or liner to the clamping surface, with no or little possible adjustment of the location of such region, and also lack the facility to vary at will the workpiece supporting dimensions of the block or liner extending beyond or outside the clamping surfaces—and certainly not without separation of the magnetic holding between the block or liner and clamping surface—such as to adapt continually to support different surface configurations, shapes and portions of the workpiece-to-be-clamped.

OBJECTS OF INVENTION

It is accordingly an object of the invention to provide a new and improved magnetic workpiece clamping block that shall not be subject to the above and other limitations of prior clamping blocks and that, to the contrary, enables ready adjustability and flexible variation of the position of magnetic attachment of the block relative to and even extending beyond the perimeter of the clamping surface, and all without magnetic separation of the block and clamping surface.

A further object is to provide such a novel workpiece block in which the magnetic holding force between block and clamping surface is automatically maintained less during adjustment to permit freedom of relative movement without separation, and then becomes greater during clamped holding of the workpiece to aid in preventing such relative movement.

Other and further objects will be explained hereinafter and are more particularly delineated in the appended claims.

SUMMARY

In summary, however, the invention embraces a relatively resiliently compressible block for ready attachment to and removal from a workpiece clamping surface of relatively hard ferrous metal, said block having opposing flat surfaces of area larger than that of the clamping surface; one surface being provided substantially throughout its area with a resilient magnetized plastic surface for contacting the ferrous metal clamping surface at variable desired subareas of said block surface and magnetically attaching thereto, said subareas being selected to accommodate for different shapes and orientations of the workpiece-to-be-clamped; and the opposite surface of the block providing for engaging the workpiece and cushioning the same from the hard metal clamping surface when operated to clamp the same; the force of magnetic attachment of the uncompressed resilient magnetized plastic surface to the clamping surface being sufficient to permit readily movable relative sliding adjustment of the position of the block over the clamping surface to select desired block subareas of attachment as in setting up the workpiece, and without magnetic detachment of block and clamping surface during such adjustment, but less than the increased magnetic attachment force resulting upon clamping compression of the resilient magnetized plastic surface which supplements the mechanical clamping force to secure the attachment of the block and clamping surface against relative movement in clamped condition. Preferred and best mode designs and embodiments are later explained.

DRAWINGS

Figure 2A:
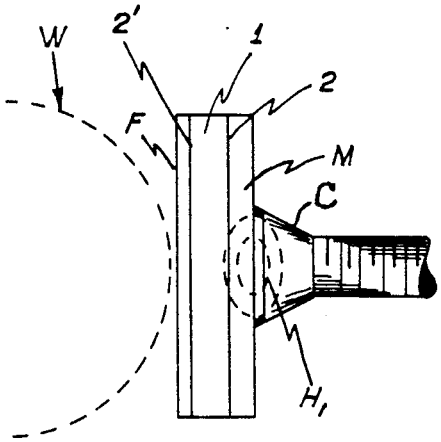
Figure 2B:
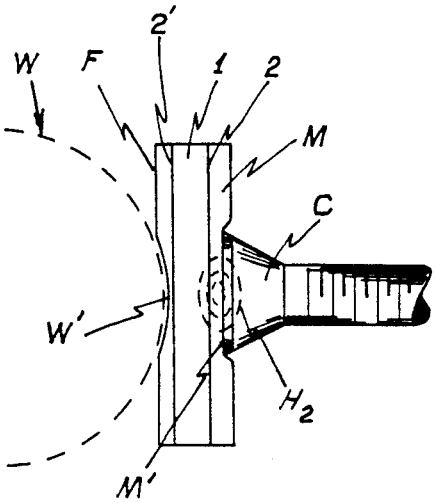
Figure 3A:
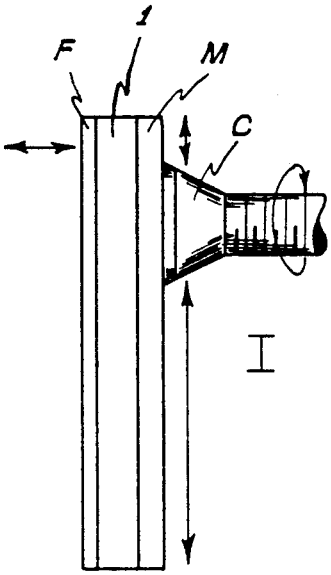
Figure 3B:
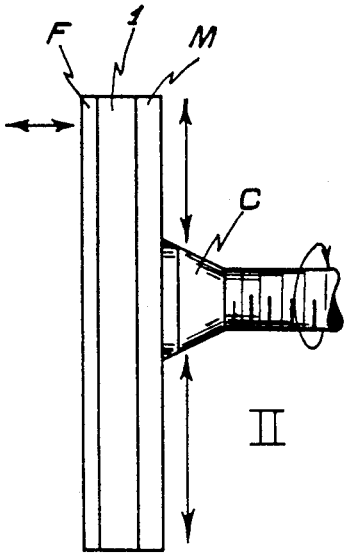
Figure 3C:
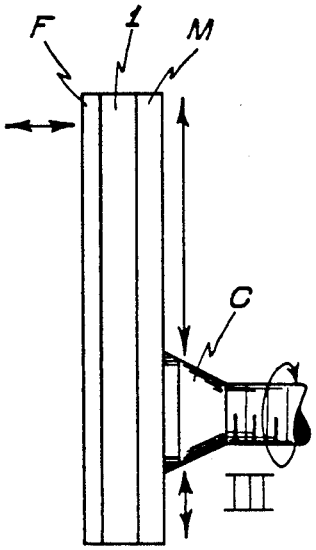
Figure 4A:
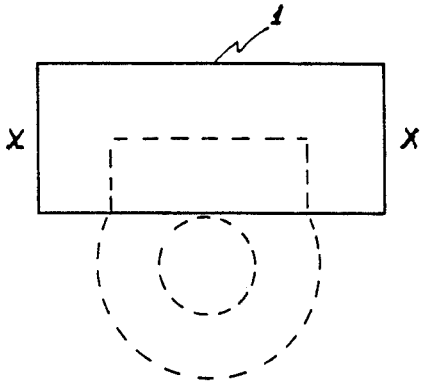
Figure 4B:
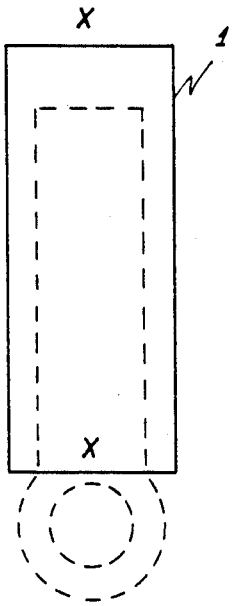
Figure 4C:
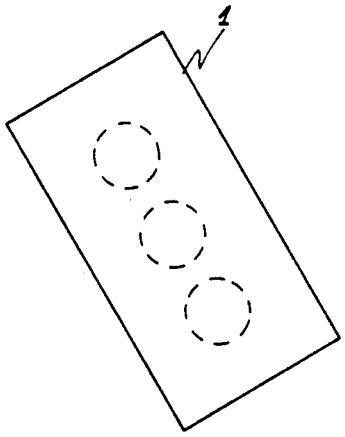
Figure 5A:
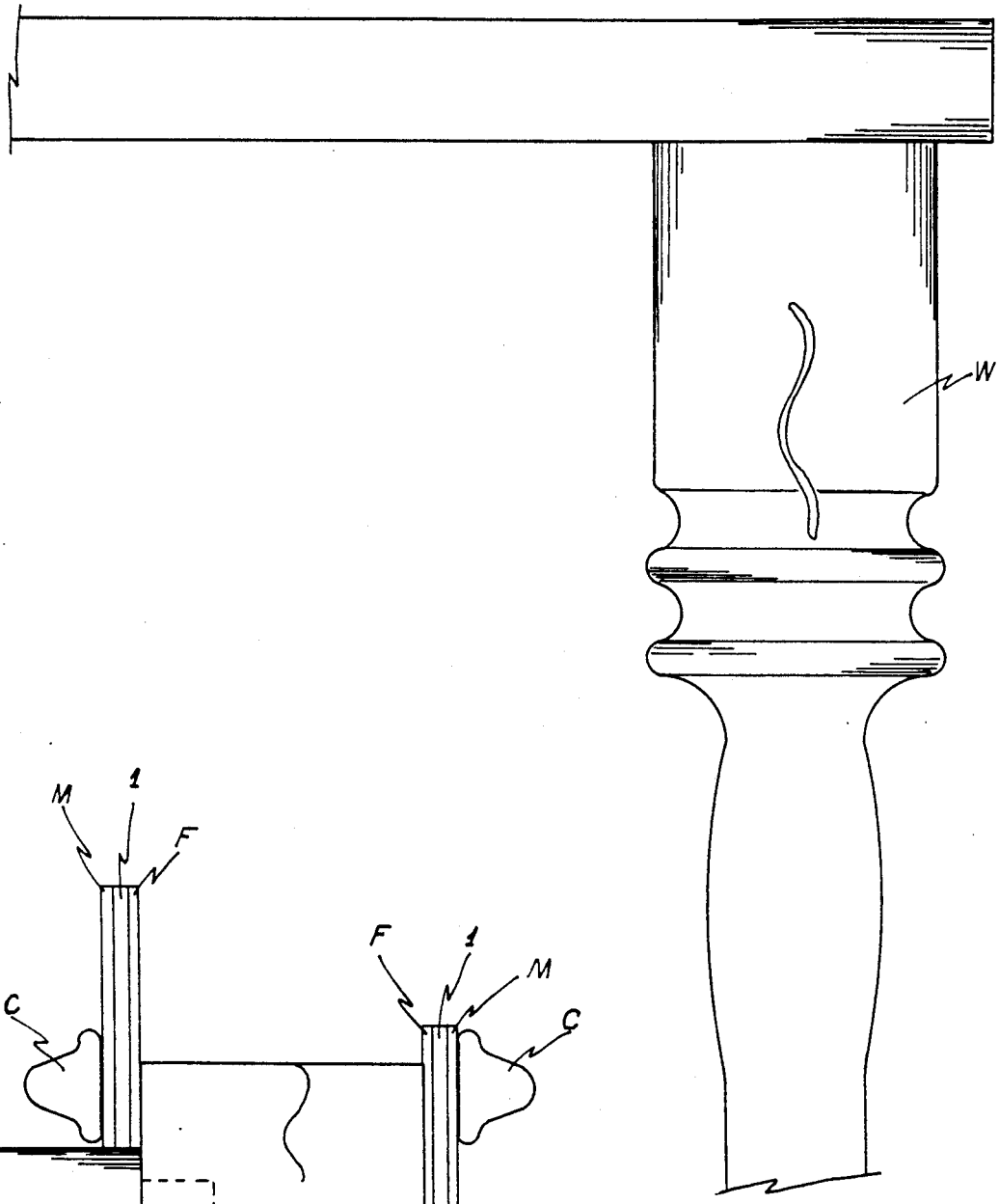
Figure 5B:
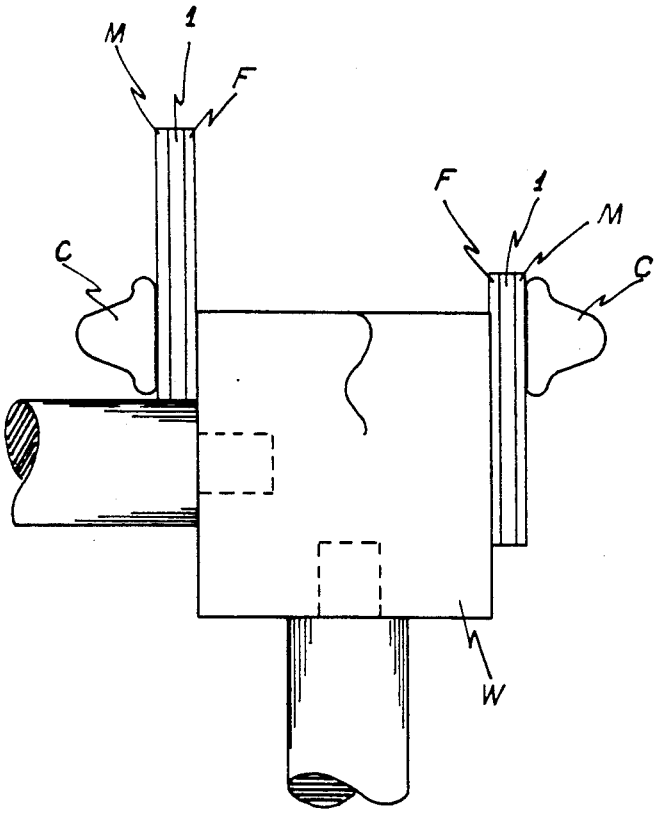

The invention will now be described in connection with the accompanying drawing, FIG. 1 of which is an isometric view of the invention as applied to an illustrative adjustable C-clamp, in preferred form;

FIGS. 2A and 2B are side elevations showing unclamped and clamped positions, respectively;

FIGS. 3A, 3B, and 3C are similar views showing relative block ahd clamp movement during magnetic holding;

FIGS. 4A, 4B and 4C show various block orientations possible with the invention; and FIG. 5 is a view of the clamping of a table leg workpiece of the type shown in FIG. 5A, showing the flexibility of the invention.

Referring to FIG. 1, a preferred clamping block 1 is shown constructed in accordance with the present invention of relatively or somewhat resiliently compressible thin wood, plastic or other similar material with opposite substantially parallel surfaces 2 and 2'. The thickness of the block is sufficient to provide a useful life with some degree of repeatable shape recovery after compression. In practice, a pair of such blocks, either of the same or different dimensions, is used to cushion and protect a workpiece, schematically generalized at W, from surface damage by the relatively hard clamping surfaces C—C' of, for example, an adjustable C-clamp having threaded adjustable clamping jaw C for enabling clamping of the workpiece W so as to permit, for example, working, tooling or finishing operations thereupon. While a C-clamp is illustrated, the invention is useful also with all types of clamps and vises. In woodworking, for example, bar clamps, C-clamps and bench vises are widely used, and the blocks of the invention act as a buffer between clamp jaw and workpiece that avoids denting, scratching, etc., by the clamp. The block surfaces, as shown, however, are preferably of greater area than that of the clamping surfaces C—C' for the important variable-positioning and supporting functions later more fully described.

The inner surface 2 of the blocks that is to be engaged by the clamping surfaces C—C' is provided substantially throughout its surface area with a compressible but resilient plastic magnetic strip covering M which enables magnetic attachment to the ferrous metal clamp surfaces C—C' C'. The magnetic holding force H1, FIG. 2A, is made sufficient as by appropriate thinness and pre-magnetication to hold the block on the clamp surface C, and to do so while permitting easy sliding movement adjustment of the block over the clamping surface C to vary the sub-area or regions or position of the block contacting the clamping surface without breaking or separating the magnetic holding therebetween.

FIGS. 3A, B and C show the block with three different positions of attachment to the clamping surface C, I, II and III, effected merely by relative sliding while the block is magnetically held to the clamp surface and with different degrees of block extension beyond the clamping surface area. FIGS. 4A, B and C further illustrate the facile sliding of the block, while held to the clamp magnetically, in various orientations—horizontal, vertical and at an incline. This thus permits ready adjustment of the orientation and amount of supporting block surface available for different workpiece shapes, geometries and other requirements. The block, moreover, stays magnetically attached to the clamping surface even during rotary adjustment of the threaded clamping surface C (rotating with the clamping surface as a unit) and prevents the slipping or separation that otherwise would occupy the hands of the operator in trying to orient and clamp or unclamp the workpiece W and assemble or remove the same with or from the pair of blocks interposed between the clamping surfaces.

If desired, as shown, a thin relatively resilient felt-like cushion layer F may be applied to the workpiece-contacting-and-cushioning surface 2' which will indent, as will the block 1, ($W^1$), on clamping engagement with the workpiece, FIG. 2B, and then expand back, at least to some degree, on clamp release, FIG. 2A.

When the blocks are clamped against the workpiece W, moreover, the resilient plastic magnetic strip M also becomes resiliently compressed at the region M' only of the clamping surface C, FIG. 2B, bringing more magnetic material closer to the clamping surface at that region M' and thus creates a greater magnetic holding force H2 that aids and supplements the mechanical clamping holding of the blocks and workpiece in resisting relative movement or slippage between the block and the clamping surface. When, however, the assembly is unclamped, the resilient magnetic strip M springs back to its uncompressed form, lessening the magnetic holding force to the clamp surface H1, FIG. 2A, so as to permit ready sliding positioning of the block again as in FIGS. 3A, B and C.

FIGS. 5A and B, as a further example, show the flexibility of the different unsymmetrical areas of possible block attachment and workpiece support relative to the clamp area for a table leg assembly. With fixed central position clamp-block assemblies, as in the prior art, less support of the workpiece surfaces is achievable and some bowing of the block surfaces when clamped with an object such as that of FIG. 5A, is unavoidable. When working with a brand new table top or some regular unfinished stock, as shown in FIG. 5A, the clamping involves several considerations. One must first align laterally and vertically to the same elevation because one has to tighten the clamps up on the piece as it is set up to come together.

Otherwise, the pieces move together—some move up, some move down. This allows the clamps to be in vertical alignment and horizontal alignment at the same time and to tighten the clamp at the same time as well. With the invention, however, all one has to do is worry about the horizontal and vertical, because the clamp stays in place regardless. New stock, new construction, or repair of an existing piece is more viable with the technique of the invention.

For example, with a flexible plastic magnetic strip tape 0.60" thick in uncompressed form, such as that marketed by Jobmaster Corporation of Randallstown, Maryland, Magnetized 11PPI, successful operation as above-described has been obtained, particularly useful for woodworking applications, with the magnetic tape being adhesively secured over the complete surface 2 of a pine wood block 1 of from about $\frac{1}{8}$ to $\frac{1}{4}$" thick. The flexible magnetic tape layer is preferably of the order, thus, of one half to one quarter the block thickness for successful operation as described, and reasonable life of continued resiliency. The felt layer, if used, is preferably thinner than the magnetic layer, say of the order of one-half the thickness of the same. Block dimensions from one to several inches on a side are most useful.

Thus the invention has opened up a new flexibility and and set of functions, unattainable with the prior art magnetic blocks as heretofore used with clamps and vises. The magnetic tape covering the entire block surface, in accordance with the invention, allows the block to be positioned anywhere on the C-clamp, pipe clamp or other clamping device conveniently and with little effort and frustration. The magnetic tape, moreover, under compression is magnetically stronger and holds the block securely in place; but when released, the magnetic field is less and the block is readily relocated. The magnetic surface M covering the entire surface of the block, in addition, helps to keep the block from distortion or splitting; whereas prior art button-type or other fixed magnets tend to weaken the block and, if not carefully located on the clamp, can cause the block to split. The construction of the invention, furthermore, allows the block to be made thinner and easier to handle than thicker button-type blocks.

While described as applied for woodworking, clearly the invention, with suitable materials, is useful in metal, plastic and other workpiece operations and in other finishing, abrading or other systems where similar problems addressed by the invention are present Further modifications will occur to those skilled in this art and such are considered to fall within the spirit and scope of the invention as defined in the appended claims.

What is claimed is:

1. A relatively resiliently compressible block for ready attachment to and removal from a workpiece clamping surface of relatively hard ferrous metal, said block having opposing flat surfaces of area larger than that of the clamping surface; one surface being provided substantially throughout its area with a resilient magnetized plastic surface for contacting the ferrous metal clamping surface at variable desired subareas of said block surface and magnetically attaching thereto, said subareas being selected to accommodate for different shapes and orientations of the workpiece-to-be-clamped; and the opposite surface of the block providing for engaging the workpiece and cushioning the same from the hard metal clamping surface when operated to clamp the same; the force of magnetic attachment of the uncompressed resilient magnetized plastic surface to the clamping surface being sufficient to permit readily movable relative sliding adjustment of the position of the block over the clamping surface to select desired block subareas of attachment as in setting up the workpiece, and without magnetic detachment of block and clamping surface during such adjustment, but less than the increased magnetic attachment force resulting upon clamping compression of the resilient magnetized plastic which supplements the mechanical clamping force to secure the attachment of the block and clamping surface against relative movement in clamped condition.

2. A clamping block as claimed in claim 1 and in which the force of magnetic attachment of the block magnetized plastic to the metal clamping surface before clamping of the workpiece being also sufficient to hold the block so magnetically attached during movement of the clamping surface against or away from the workpiece.

3. A relatively resiliently compressible block for ready attachment and removal from a workpiece-clamping surface of relatively hard ferrous metal, having opposing flat surfaces, one surface of which is provided substantially throughout its area with a compressible and resilient magnetized plastic surface for contacting the ferrous metal clamping surface and slidably movable to variable desired subareas of said block surface while remaining magnetically attached to the clamping surface; and an opposite surface providing a workpiece engaging and cushioning surface.

4. A clamping block as claimed in claim 3 and in which said opposite surface is provided with a felt cushion.

5. A clamping block as claimed in claim 3 and in which the resilient magnetized plastic surface is an adhered layer of the order of one half to one quarter the thickness of the block.

6. A clamping block as claimed in claim 5 and in which the block is of wood of the order of $\frac{1}{8}$–$\frac{1}{4}$ inch thick.

* * * * *